United States Patent [19]

Mitani

[11] Patent Number: 4,793,876

[45] Date of Patent: Dec. 27, 1988

[54] SOUND-DEADENING AND VIBRATION-ABSORBING β'-MARTENSITE TYPE ALUMINUM-BRONZE ALLOY

[75] Inventor: Hiroyasu Mitani, Toyonaka, Japan

[73] Assignee: Sumitomo Electric Industries, Ltd., Osaka, Japan

[21] Appl. No.: 78,023

[22] Filed: Jul. 24, 1987

Related U.S. Application Data

[63] Continuation of Ser. No. 798,684, Nov. 15, 1985, abandoned.

[30] Foreign Application Priority Data

Nov. 21, 1984 [JP] Japan ..... 59-247492

[51] Int. Cl.[4] ..... C22C 9/01

[52] U.S. Cl. ..... 148/436; 148/435

[58] Field of Search ..... 148/436, 435

[56] References Cited

U.S. PATENT DOCUMENTS 2,870,051 1/1959 Klement ..... 148/436

3,653,980 4/1972 Eichelman, Jr. ..... 148/436

*Primary Examiner*—R. Dean

*Attorney, Agent, or Firm*—Wenderoth, Lind & Ponack

[57] ABSTRACT

The present invention relates to a sound-deadening and vibration-absorbing β'- martensite type aluminum-bronze alloy and provides a Cu-Al alloy containing Al in an amount of 8 to 14% by weight and having a β'-martensite type structure at a normal temperature or a sound-deadening and vibration-absorbing β'-martensite type aluminum-bronze alloy having superior characteristics as vibration- and sound-insulation materials, containing Al in an amout of 8 to 14% by weight and at least one member selected from the group consisting of Fe, Ni, Mn and B as a second ingredient in an amount of 4% by weight or less, and having a β'-martensite type structure at a normal temperature.

1 Claim, 5 Drawing Sheets

SOUND-DEADENING AND VIBRATION-ABSORBING β'-MARTENSITE TYPE ALUMINUM-BRONZE ALLOY

This application is a continuation of now abandoned application Ser. No. 798,684, filed Nov. 15, 1985, now abandoned.

DETAILED DESCRIPTION OF THE INVENTION

1. Field of the Invention

The present invention relates to a sound-deadening and vibration-absorbing β'-martensite type aluminum-bronze alloy having superior characteristics as vibration- and sound-insulation materials.

2. Description of the Prior Arts

The present inventor found that a Cu-Al-Ni-γ-martensite type sintered alloy is remarkably superior as a sound-deadening and vibration-absorbing oil-moistened bearing alloy and filed an application for patent (Japanese Patent Publication No. 56-47942).

In addition, the present inventor published his studies of Cu-Al-Niγ'-martensite type sintered alloys on Japanese and foreign scientific journals such as Powder Metallurgy International, Journal of Japanese Metal Institute and Powder Metallurgy in which it was confirmed that Cu-14% Al-8% Ni exhibited the maximum internal friction among γ'-martensite type Cu-Al-Ni sintered alloys.

The present invention aims at the application of β'-martensite type aluminum-bronze sintered materials, which are superior in vibration- and sound-insulation, as casting materials suitable for large-sized parts and a small-quantity production.

3. Description of the Present Invention

The present inventors achieved the present invention as a result of various investigations on the characteristics of sound-deadening and vibration-absorbing martensite type aluminum-bronze alloys obtained by a dissolving casting method.

That is to say, sound-deadening and vibration-absorbing Cu-Al alloys having a β'-martensite type structure at a normal temperature exhibit particularly high sound-deadening and vibration-absorbing effects if they contain Al in an amount of 8 to 14% by weight. Also P may be added in an amount of 0.25 by weight or less.

The present invention relates to also sound-deadening and vibration-absorbing β'-martensite type aluminum-bronze alloys, characterized in that Al is contained in an amount of 8 to 14% by weight and at least one kind selected from a group consisting of Fe, Ni. Mn and b in an amount of 4% by weight or less as a second ingredient.

Figure 1:
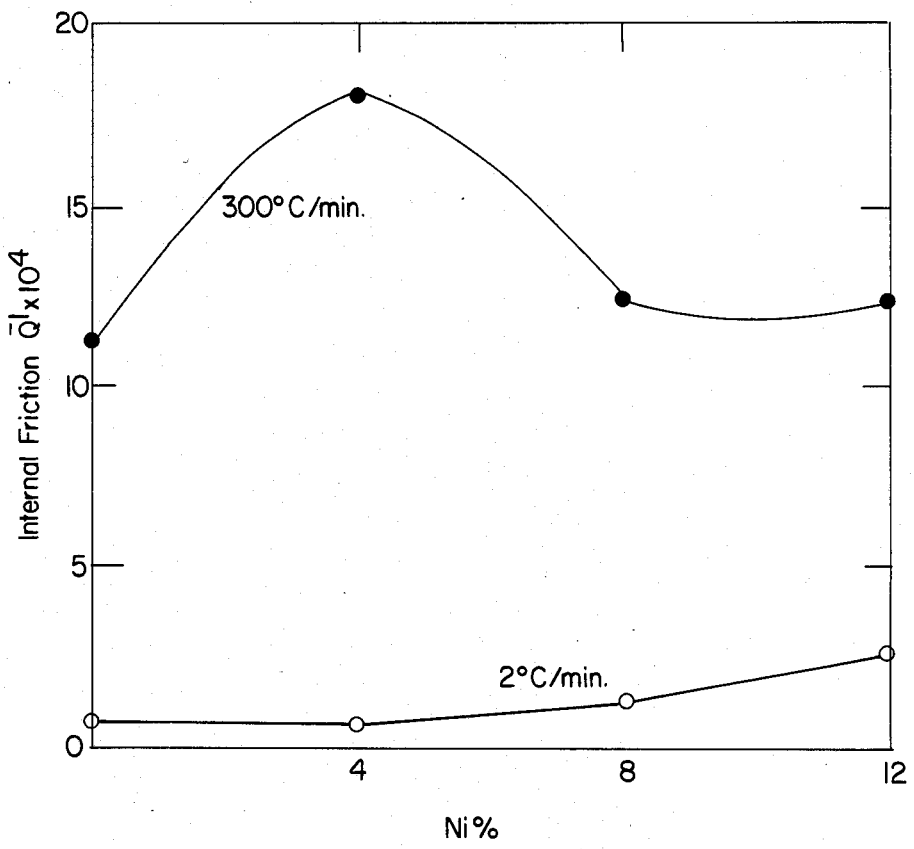
Figure 2:
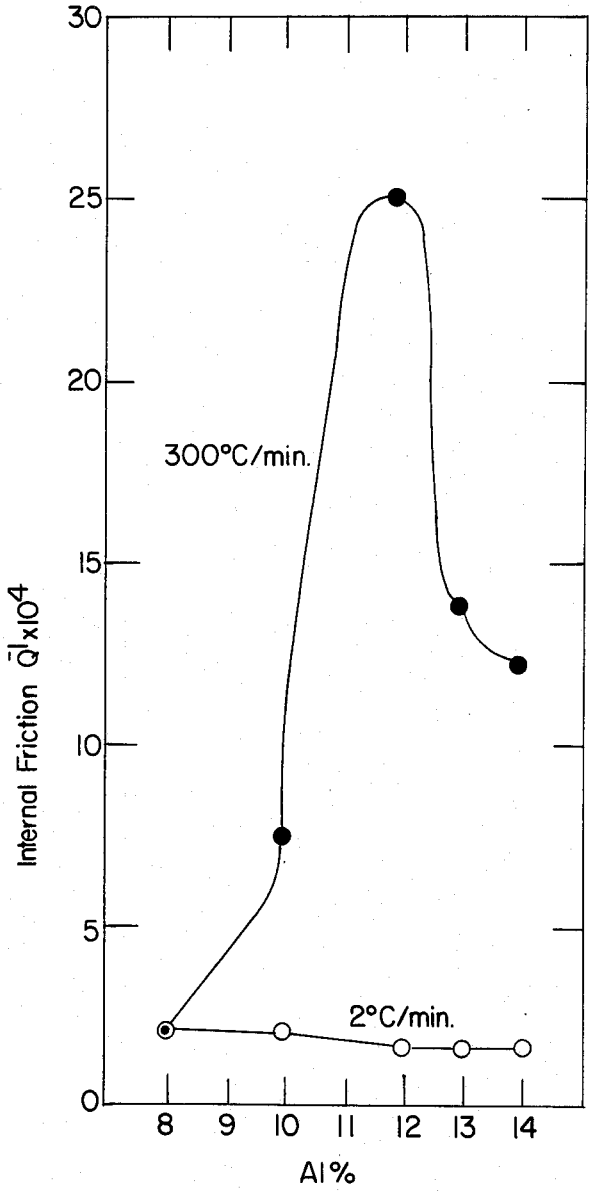
Figure 3:
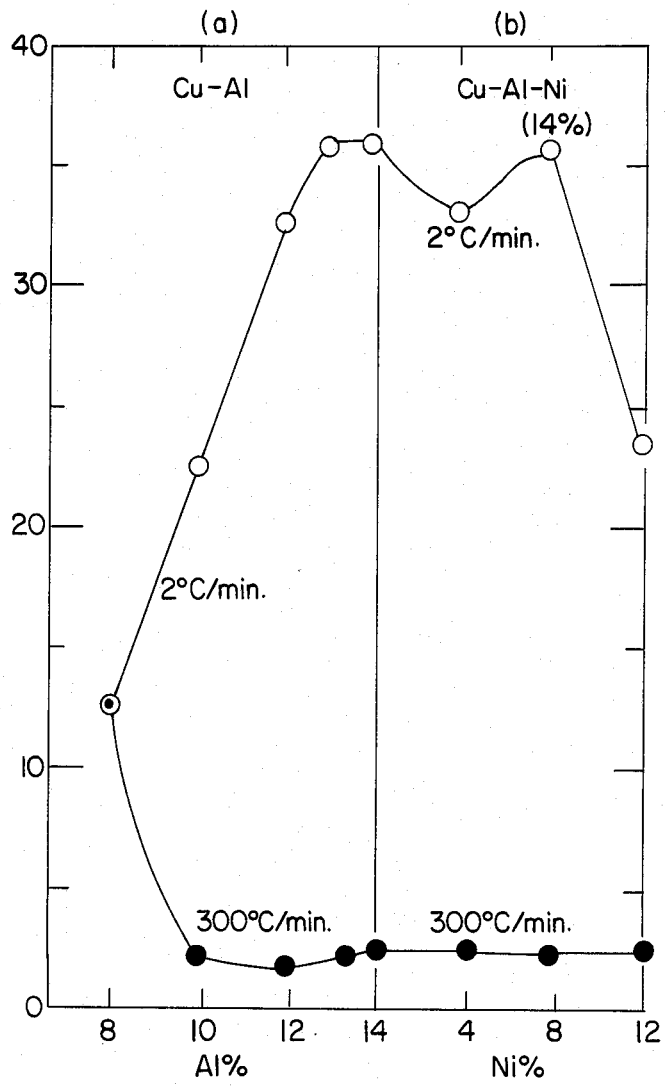
Figure 4:
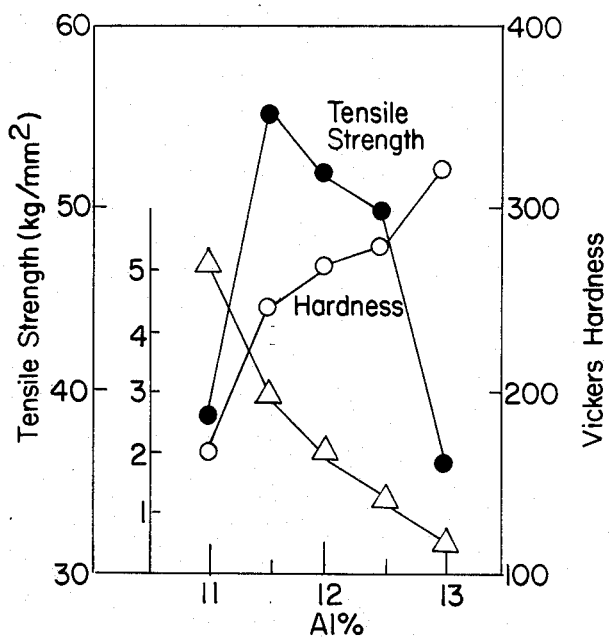
Figure 5:
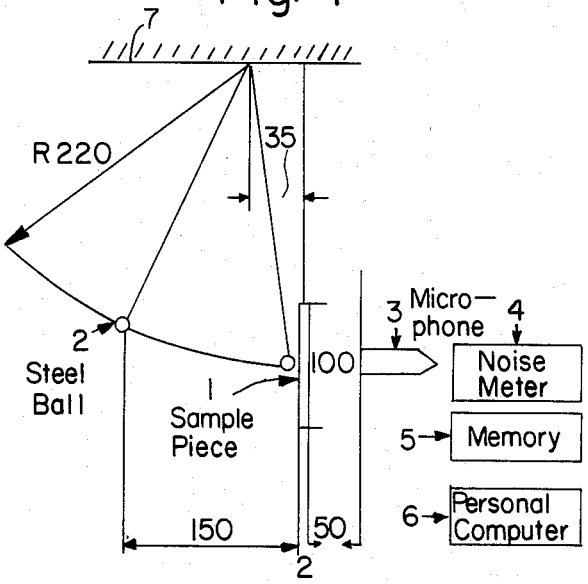
Figure 6:
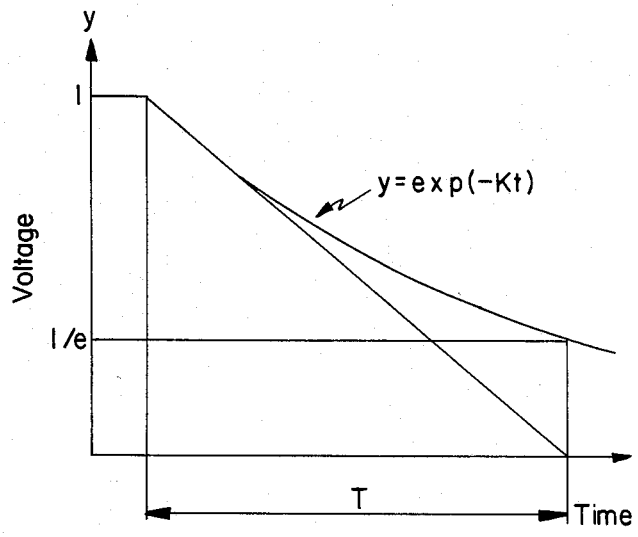

The present invention will be below described in detail with reference to a preferred embodiment. The drawings illustrate the preferred embodiment, in which FIG. 1 is a graph showing influences of Ni-content and cooling speed on an internal friction of Cu-14% Al-Ni alloys, FIG. 2 is a graph showing influences of Al-content and cooling speed on an internal friction of Cu-Al alloys, FIG. 3 is a graph showing the relationship of Al-content of a Cu-Al alloy, Ni-content of Cu-14% Al-Ni alloy and a reverberation time, FIG. 4 is a graph showing a relation among an Al-content, strength, Vickers hardness and elongation of Cu-Al alloy, FIG. 5 is a diagram showing a percussion sound-measuring apparatus used for the evaluation of alloys obtained according to the present invention, and FIG. 6 is a diagram showing a measuring principle of a reverberation time.

Four kinds of alloy containing Al at a constant ratio of 14% (hereinafter all expressed in % by weight) and Ni in an amount of 0, 4, 8 and 12%, respectively, were melted at temperatures of about 1,250° C. and then were cast in a mold (outside size of 200 mm×70 mm×70 mm) made of cast iron preliminarily heated to 1,150° C. to obtain cast samples having a size of 150 mm×30 mm×9 mm. Two sample pieces having a size of 100 mm×10 mm×2 mm were prepared from the cast samples. The chemical composition of each sample is shown in Table 1.

TABLE 1

| Sample No. | Result of Chemical Analysis of Cu—Al—Ni Alloys Al | Ni | Cu |
|---|---|---|---|
| 14-12 | 13.97 | 12.50 | Rest |
| 14-8 | 13.93 | 8.05 | " |
| 14-4 | 13.96 | 4.14 | " |
| 14-0 | 13.97 | — | " |
| 13-0 | 12.88 | — | " |
| 12-0 | 11.96 | — | " |
| 10-0 | 10.09 | — | " |
| 8-0 | 7.95 | — | " |

The above described samples were tested on an internal friction by a transverse vibration method. The measurement was carried out at a room temperature of 27° C. and a strain amplitude of about $7.8\times10^{-5}$ was selected. Provided that an attenuation constant of amplitude is δ, an internal friction (internal loss) $Q^{-1}$ is expressed by the following equation:

$$Q^{-1}=\delta/\pi$$

Each sample was heated to 900° C. followed by holding at that temperature and then cooling from 600° C. to 500° C. by an air cooling at a rate of about 300° C./min and 2° C./min. The cooled sample was tested for an internal friction. The results are shown in FIG. 1.

It is found from FIG. 1 that the internal loss is low for all samples cooled at a rate of about 2° C./min and they are not martensized.

On the contrary, the internal loss is increased until 10 times or more that for the samples cooled at a rate of about 2° C./min in the samples cooled at a rate of about 300° C./min.

Particularly, the sample comtaining Ni in an amount of 4% showed a peak and a result different from that in a sintered body. Accordingly, since the influence caused by the addition of Ni is comparatively poor, the samples containing Al at a lowered ratio and without containing Ni were tested similarly. The results are shown in FIG. 2.

It is found from FIG. 2 that unexpectedly the sample containing Al in an amount of 12% shows a sharp peak and an internal loss ($Q^{-1}$) of which amounts to $25\times10^{-4}$ which is several ten times that in non-transformed samples having the same composition.

It has been proved by the present inventor for a long time that the samples containing Al in an amount of 12% cooled at a rate of aout 2° C./min are formed of $\beta'$-martensite.

It is suggested from the above described results that of aluminum-bronze alloys obtained by melting a $\beta'$-martensite type Cu-12% Al alloy shows the highest internal loss and a remarkably superior sound-deadening and vibration-insulating effect.

In order to practically use an alloy according to the present invention for a sound-deadening and vibration-insulating material, it is desired that a reverberation time of percussion sound is short and secondly tensile strength is large. Accordingly, the above described materials were tested on reverberation time and tensile strength.

All of the above described Cu-Al and Cu-14% Al-Ni cast alloys were tested on reverberation time. The comparison result is shown in FIG. 3(*a*).

It is found from FIG. 3(*a*) that the samples containing Al in an amount of 8% similarly show a reverberation time of 12.5 ms regardless of their cooling manner. A reverberation time is linearly increased with an increase of Al-content in the samples cooled at a rate of about 2° C./min and becomes constant at an Al-content of 13%. In the samples cooled at a rate of about 300° C./min a reverberation time is remarkably reduced with an increase of Al-content until an Al-content of 10% and the sample containing Al in an amount of 12% shows a minimum reverberation time. And, a reverberation time is slightly increased with an increase of Al-content from 10% to 13% and becomes constant at an Al-content of 13%.

FIG. 3(*b*) is a curve showing a reverberation time of Cu-14% Al-Ni alloys containing Ni in an amount of 4, 8 and 12%. In the samples cooled at a rate of about 2° C./min the reverberation time is almost constant until a Ni-content of 8% but suddenly decreased at an Al-content over 8%. In the samples cooled at a rate of about 300° C./min the reverberation time is hardly influenced by a Ni-content which shows an unnecessity of adding Ni.

It is found from the above described results that the results of acoustic experiments also coincide well with an inclination in the basic experiments of internal friction and a $\beta'$-martensite type Cu-12% Al alloy shows the highest sound-deadening and vibration absorbing property. This proves that the sample having a composition according to the present invention is concretely effective.

FIG. 4 shows the relationship among tensile strength, elongation and hardness of $\beta'$-martensite type Cu-Al cast alloys containing Al in an amount of 11.0, 11.5, 12.0, 12.5 and 13.0%.

It is found from FIG. 4 that $\beta'$-martensite type Cu-Al cast alloys containing Al in an amount of 11.5 to 12.5% are optimum in view of tensile strength but those containing Al in an amount of 12.5% or more are hard and fragile thereby they can not be practically used and a Cu-Al alloy containing Al at a ratio of 11% has tensile strength of about 40 kg/mm$^2$ and larger elongation thereby being able to be practically used.

The above described test on strength also proves that alloys having a composition according to the present invention are appropriate also in view of strength.

In addition, Fe, Ni, Mn and B are elements effective for making crystals of Cu-Al alloys fine are added preferably in an amount of 4% by weight or less. If they are added in an amount of over 4% by weight, a contrary effect is produced. P is an element necessary as a deoxidizer but the addition thereof in an amount of over 0.25 by weight leads to the production of a contrary effect.

An apparatus used for an acoustical test and a reverberation time are supplementally described.

FIG. 5 shows instruments in the apparatus. A sample piece 1 is suspended from a rest 7 by two strings (Φ: 0.2 mm) and a percussion is given to the sample piece 1 at the central portion thereof by a movement of pendulum of a steel ball (Φ: 11 mm, about 5.4 g) 2. A percussion sound is detected by a microphone 3 and measured by a precision noise meter 4. Then it is memorized in a memory 5 and subjected to an operational treatment by a personal computer 6.

In general, a percussion sound is expressed by a sine attenuation-wave but becomes a positive cosine-wave when squared and an average value thereof is a simple attenuation logarithmic curve. Accordingly, a square mean value y of outputs is expressed by $y=\exp(-kt)$ in FIG. 6. Provided that t is time and a peak value of y is 1, t=0 at y=1 and $t=1/K$ *at* $y=1/e$. A reverberation time is defined by a value of 1/K.

EFFECTS OF THE INVENTION

As described above, in the present invention, it is found that Cu-Al alloys containing Al in an amount of 8 to 14% by weight and having a $\beta$-martensite type structure at a normal temperature or Cu-Al alloys containing Al in an amount of 8 to 14% by weight and at least one kind selected from the group consisting of Fe, Ni, Mn and b in an amount of 4% by weight or less as a second ingredient and having a $\beta'$-martensite type structure at a normal temperature exhibit superior characteristics required for vibration- and sound-insulating materials and are useful for parts for which such superior characteristics are required.

What is claimed is:

1. A $\beta'$-martensite type aluminum-bronze alloy useful for sound-deadening and vibration absorbing applications having a $\beta'$-martensite type structure at a normal temperature, consisting essentially of Al in an amount of 12 to 12.5% by weight, at least one member selected from the group consisting of Fe, Ni, Mn and B in an amount of 4% by weight or less as a second ingredient, and the balance being copper, said alloy being produced by heating to 900° C. and cooling from 600° to 500° C. at a temperature of about 300° C./min. and said alloy having an internal friction value $Q^{-1}\times 10^4$ of more than 10.

* * * * *